US006718147B1

(12) United States Patent
Carter et al.

(10) Patent No.: US 6,718,147 B1
(45) Date of Patent: Apr. 6, 2004

(54) TONER MEASUREMENT AND DARKNESS CONTROL USING PRINTER SYSTEMS

(75) Inventors: Philip Scot Carter, Lexington, KY (US); Benjamin Keith Newman, Lexington, KY (US); William Keith Richardson, Salvisa, KY (US); Jason Carl True, Lexington, KY (US)

(73) Assignee: Lexmark International, Inc., Lexington, KY (US)

( * ) Notice: Subject to any disclaimer, the term of this patent is extended or adjusted under 35 U.S.C. 154(b) by 0 days.

(21) Appl. No.: 10/287,312

(22) Filed: Nov. 4, 2002

(51) Int. Cl.[7] ..... G03G 15/08; G03G 15/10
(52) U.S. Cl. ..... 399/27; 399/58
(58) Field of Search ..... 399/24, 27, 29, 399/30, 53, 58, 61

(56) References Cited

U.S. PATENT DOCUMENTS

| | | | | | |
|---|---|---|---|---|---|
| 4,136,945 | A | | 1/1979 | Stephens | |
| 4,847,659 | A | | 7/1989 | Resch, III | |
| 4,969,011 | A | | 11/1990 | Faull et al. | |
| 5,272,503 | A | | 12/1993 | LeSueur et al. | |
| 5,634,169 | A | | 5/1997 | Barry et al. | |
| 5,794,094 | A | * | 8/1998 | Bockholdt et al. | 399/27 |
| 5,797,061 | A | | 8/1998 | Overall et al. | |
| 5,802,420 | A | | 9/1998 | Garr et al. | |
| 5,839,022 | A | * | 11/1998 | Wang et al. | 399/30 X |
| 5,937,225 | A | * | 8/1999 | Samuels | 399/27 |
| 5,970,275 | A | * | 10/1999 | Brown, Jr. et al. | 399/27 |
| 6,160,970 | A | * | 12/2000 | Scheuer et al. | 399/58 |
| 6,167,213 | A | * | 12/2000 | Buranicz et al. | 399/58 |
| 6,175,375 | B1 | | 1/2001 | Able et al. | |
| 6,229,970 | B1 | | 5/2001 | Onimura et al. | |
| 6,246,841 | B1 | | 6/2001 | Merrifield et al. | |
| 6,404,997 | B1 | * | 6/2002 | Grace | 399/27 |
| 6,456,802 | B1 | * | 9/2002 | Phillips | 399/27 |

* cited by examiner

*Primary Examiner*—Sandra Brase
(74) *Attorney, Agent, or Firm*—John A. Brady

(57) ABSTRACT

Toner usage is measured with good accuracy. Printing tends to darken with the depletion of toner from a source. A toner cartridge employed in a printer (70) has the capability at the cartridge of determining the amount toner used. In an embodiment this is by a torsion spring (60) drive to a toner paddle (3). At turn-on and cover open, the amount of toner is measured at the cartridge (80). That is stored in NVRAM (78) when it is very different from the current amount stored in NVRAM. At certain amount levels observed at the cartridge the amount in NVRAM is revised to the new amount. Between those levels the amount of toner used is tracked by counting pels (94). Use amounts are converted to operating factors in a table (100), and the operating factors are applied to the printer to keep the darkness of printing more constant. Writing to NVRAM is minimized.

17 Claims, 6 Drawing Sheets

TONER MEASUREMENT AND DARKNESS CONTROL USING PRINTER SYSTEMS

TECHNICAL FIELD

This invention relates to electrostatic imaging devices, such as printers, which measure toner usage and which adjust operating voltages or the like to compensate for darkness shift of toner applied as toner is used from a depleting source of toner. A typical embodiment is a printer employing a replaceable toner cartridge from which toner is exhausted during printing.

BACKGROUND OF THE INVENTION

The characteristics of an electrophotographic system can change over the usage of a given toner cartridge or other toner source. When certain characteristics change, there is a shift in print darkness over the life of use of the cartridge or other toner source as it depletes toward becoming empty. Factors which contribute to this change may include differences in toner with use (smaller particles tend to print earlier), photoconductor wear, and doctor blade wear. A gradual shift toward darker printing results from such changes.

U.S. Pat. No. 6,175,375, which is assigned to the same assignee to which this application is assigned, is to changing the electrophotographic operating points as a function of how much toner has been used from a toner source to compensate for the shift in print darkness resulting from usage. The operating points which can be changed to influence darkness are normally one or more voltage levels employed to charge the photoconductor, to charge a developer roller, or to transfer toner from the photoconductor to the paper or other media being imaged.

In order to carry out such darkness control, usage of a cartridge or other toner source must be available to the control mechanism of the imaging device. Accurate measurement for this purpose is important. It is desirable in certain applications not to store usage in the cartridge, but instead to use existing elements in the printer. Standard electronic printer control mechanisms include both temporary memory (random access memory or RAM) and some permanent memory (non-volatile memory or NVRAM), and a microprocessor or other data processing apparatus to operate on data and retrieve and store data in the RAM and NVRAM.

Also known is a toner cartridge from which the current level of toner is measured at the printer using the data processing apparatus of the printer. Specifically, U.S. Pat. No. 5,634,169, assigned to the assignee to which this application is assigned, discloses a torsion spring mounted drive to the toner stirring paddle which rotates in the hopper containing toner. When the toner reaches a certain level of depletion, the torsion spring yields less and less as the toner is depleted. The shaft to the toner paddle carries an encoder wheel, which may have multiple slots or other indicia for observation, but for the purpose of measuring toner, need only have spaced beginning and end slots. The time between observing the beginning slot and the end slot is related in a known amount to toner quantity, and pertinent factors are stored and the necessary data processing is carried out at the printer. Because of the varying postures of toner which occur in a hopper with stirring paddle, a running average is employed as the current toner-quantity measurement, a typical average being that of the last five paddle revolutions.

DISCLOSURE OF THE INVENTION

In accordance with this invention a toner container, such as a toner cartridge, in which toner load can be measured is employed with data processing apparatus in the corresponding imaging device to maintain printing darkness near a constant level during the use of the cartridge.

The factors defining changes in operating parameters with toner usage depend on the overall mechanism of the imaging device and are determined by testing and observation. These factors are stored in NVRAM of the imaging device. Since the imaging device typically has discrete darkness setting dictated by the print job or from the operating panel, such factors are required for each darkness setting.

As NVRAM can deteriorate with large amount of writing into the NVRAM, an objective is to limit the writing to the NVRAM in tracking toner usage. For this reason use data from measurement at the cartridge is entered into NVRAM only at predetermined levels. Between such levels, the RAM is used to store use data.

Another source of use data is the counting of pels printed (the pel being a single unit of a digital image). A typical digital image may be 1200 by 1200 dot per inch, so each pel is $1/1200$ inch on each side. Depending on the darkness setting different amounts of a printed pel may be conditioned to be toned, although it will appear only as a change in darkness as both the toner and the human eye tend to average the effect.

In the embodiments disclosed below, pel counting is employed to track usage between the predetermined levels observed at the cartridge and stored in the NVRAM. Such reliance on pel counting is more consistent with current usage over short terms, but may differ significantly from actual usage as graphics employing gray, for example, uses much less toner per pel than text. Accordingly, even when pel counting is used, periodic reliance on the measured toner amount at the cartridge is employed. The last amount from a measurement at the cartridge replaces the previous amount from pel counting after that last determination at the cartridge.

Also, when the imaging device is turned off or the cover opened, the toner amount measured at the cartridge is operated upon as the correct usage if it differs significantly from the amount in memory. This is important since the previous cartridge may have been replaced with a different cartridge.

BRIEF DESCRIPTION OF THE DRAWINGS

The details of this invention will be described in connection with the accompanying drawings, in which.

DESCRIPTION OF THE PREFERRED EMBODIMENTS

Toner cartridges are toner containers, which can be separated and replaced in the printer. Toner cartridges typically have some printing elements such as a developer roller with doctor blade.

Figure 1:
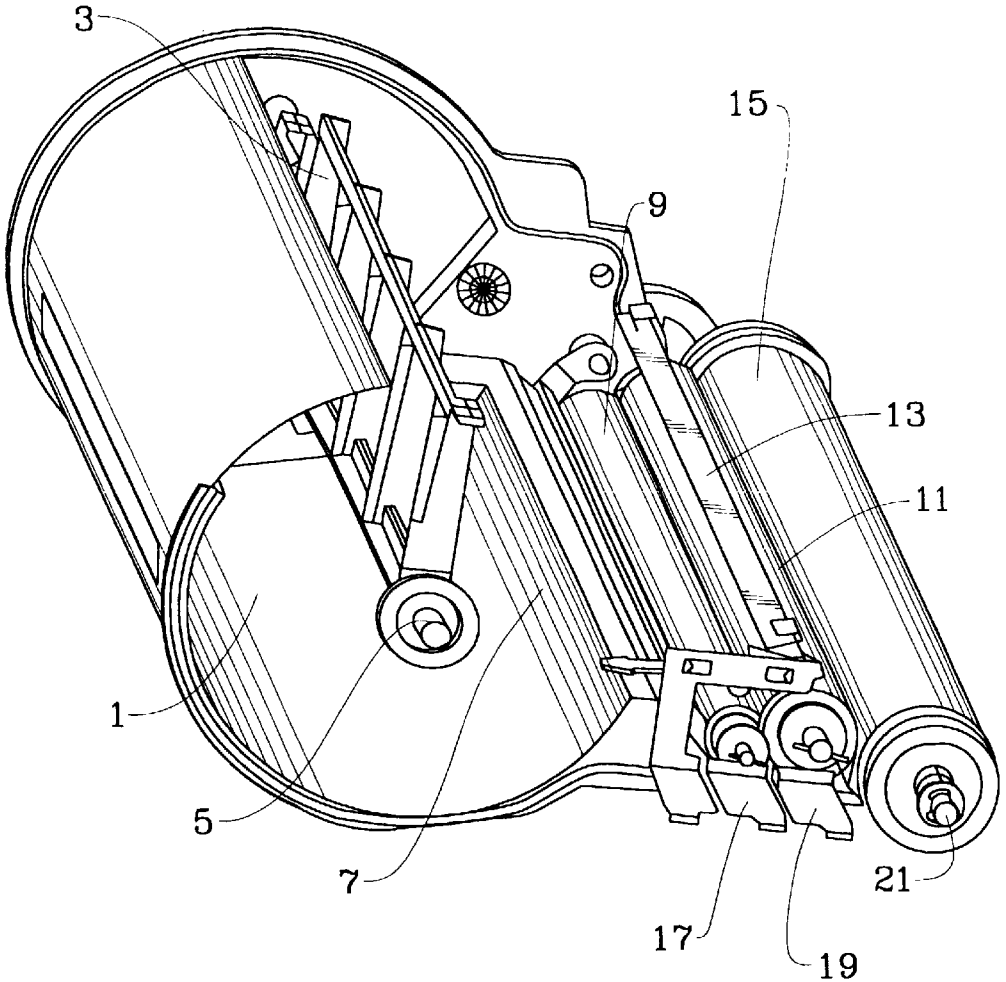
FIG. 1 PRIOR ART
FIG. 1 is a perspective, sectioned view illustrating a typical toner cartridge having a toner hopper and stirring paddle.

Referring to FIG. 1 a typical toner cartridge in accordance with this invention is shown having a toner-containing hopper 1 and a stirring paddle 3 fixedly mounted for rotation on a shaft 5. Toner (not shown) moves over wall 7 and comes in contact with a toner adder roller 9, which applies toner to a developer roller 11, both of which are rotated during operation. Toner on developer roller 11 passes under doctor blade 13 which presses against developer roller 11 before reaching photoconductor drum 15. Drum 15 carries an electrostatic image as is standard, and that image attracts toner from developer roller 11 in the pattern of the image. All of the foregoing with respect to FIG. 1 is entirely standard and prior to this invention.

Contact pads 17 and 19 apply electrical bias voltages on roller 9 and 11 respectively. An electrical bias voltage is also applied to photoconductor drum 15 through its shaft 21. Any one or more of these voltage levels are operating factors applied through pads 17 and 19 and shaft 21 that may be varied in accordance with this invention to maintain nearly constant black printing. Which operating factor to vary and their levels is not unique to this invention but is dependent on the functioning of each cartridge and imaging device. For example, although it is straightforward that decreasing the potential on developer roller 11 in a reverse-development system will increase blackness, the desirability of using that operating factor for darkness control and the ultimate effects of the variation of operating factors are determined by actual observation of individual imaging devices.

Figure 2:
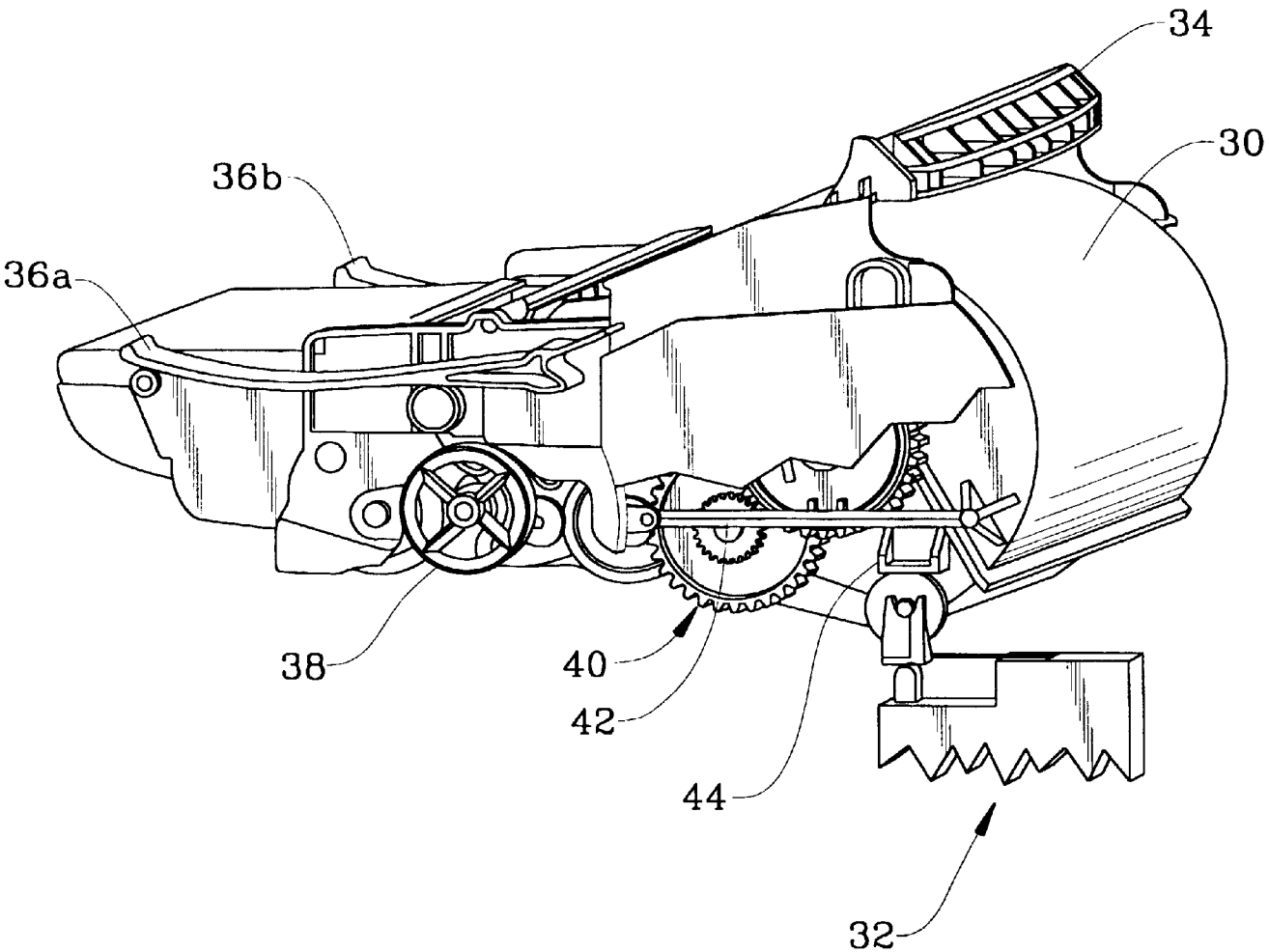
FIG. 2 PRIOR ART
FIG. 2 is a perspective view, with cover partially broken away showing a cartridge such as that of FIG. 1 in complete form and an alternative toner measuring system in which the cartridge is weighed.

FIG. 2, shows a cartridge such as that of FIG. 1 from the outside, with only a part of cover 30 not shown so a to show a weighing device 32. FIG. 2 is closely based on a view in U.S. Pat. No. 6,246,841, assigned to the same assignee to which this application is assigned, and directed to determining amount of toner by weighing, which is a alternative to the torque based system to be discussed in more detail. As shown in FIG. 2, the cartridge has a handle 34, insert guides 36*a* and 36*b*, a drive connection 38 to receive torque from the imaging device, a drive train including gears 40 and 42 from drive connection 38 to rotate the rollers 9 and 11 and the paddle 3.

Also shown is a support ledge 44, which rests on weighing device 32 in the imaging device. As indicated in the foregoing U.S. Pat. No. 6,246,841, since only toner is removed from the cartridge, changes in weight of the cartridge define the amount of toner usage.

Figure 3:
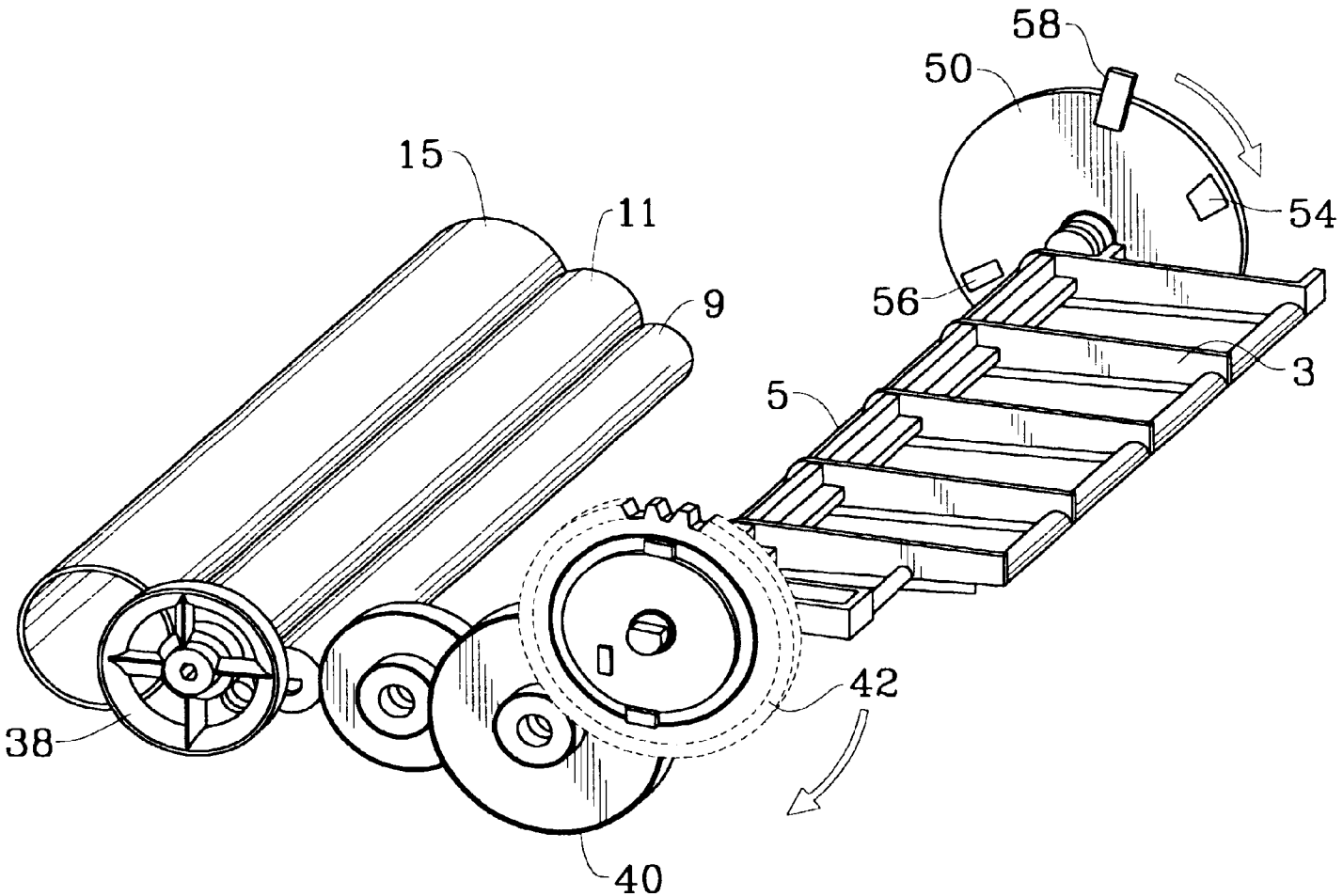
FIG. 3 PRIOR ART
FIG. 3 is a view of the encoder wheel and other selected elements of a cartridge such as that of FIG. 1.

FIG. 3 is closely based on a view of U.S. Pat. No. 5,634,169, assigned to the same assignee to which this application is assigned, and in part directed to measuring toner amount using the torsion spring drive to an encoder wheel 50. Encoder wheel 50 is modified from that of the patent to show only a beginning slot 54 and an ending slot 56 sensed by an optical sensor 58. Like parts to those in the previous figures are given the same reference numeral.

Figure 4:
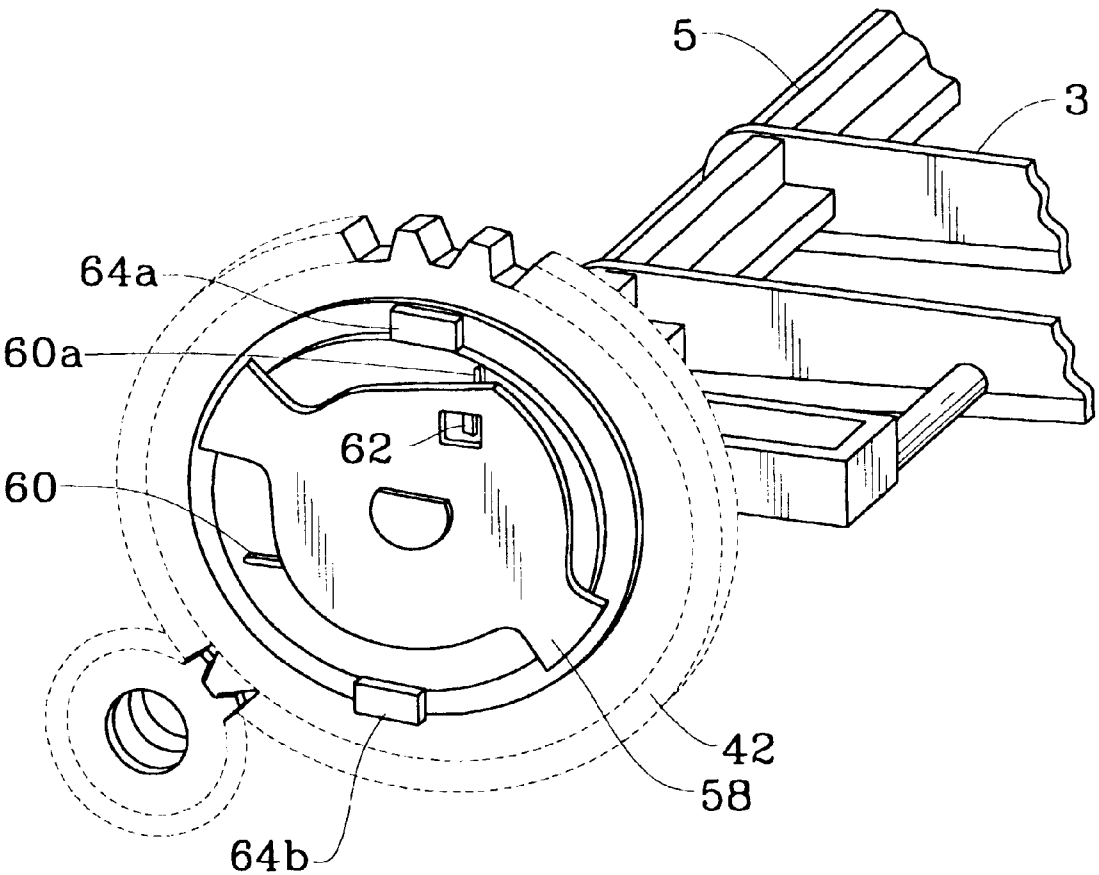
FIG. 4 PRIOR ART
FIG. 4 illustrates the torsion spring connected to drive the encoder wheel of FIG. 3.

With reference to FIG. 4 shaft 5 of paddle 3 is keyed to arbor 58. Drive gear 42 is connected to shaft 5 only through arbor 58. Arbor 58 carries a torsion spring 60 which is held by arbor 58 but has a free end 60*a*. As gear 42 rotates free end 60a contacts a ledge 62 on arbor 58. This provides a force toward rotating shaft 5. However, spring 60 will yield depending on the amount of resistance caused by toner resisting movement of paddle 3. The amount of delay is directly shown by the movement of encoder 50 and so defines the amount of toner in the cartridge. However, when the cartridge has a large amount of toner, spring 60 may yield so much that ledges 64*a* and 64*b* on gear 42 contact arbor 58 and rotate the shaft 5 directly. The foregoing with respect to the encoder wheel is standard in some printers and prior to this invention.

Figure 5:
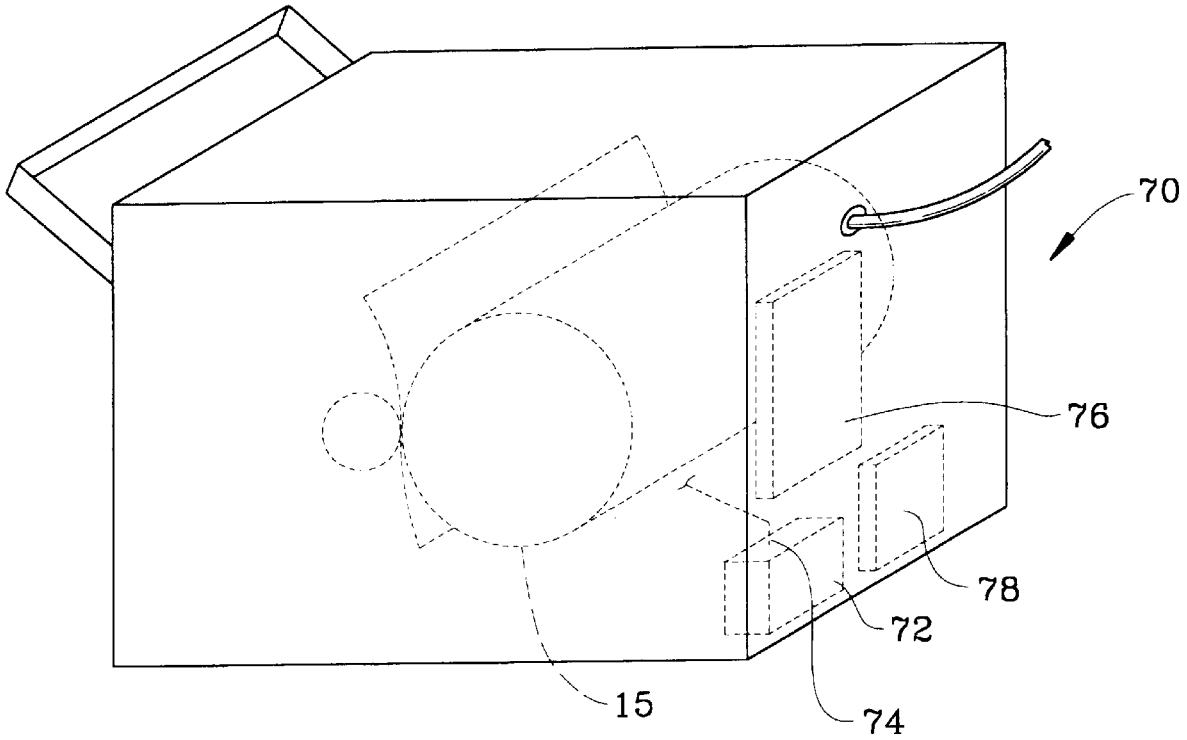
FIG. 5 is a block diagram representative of a printer or other imaging device and selected control elements in the other imaging device and not a part of the toner cartridge.
Figure 6:
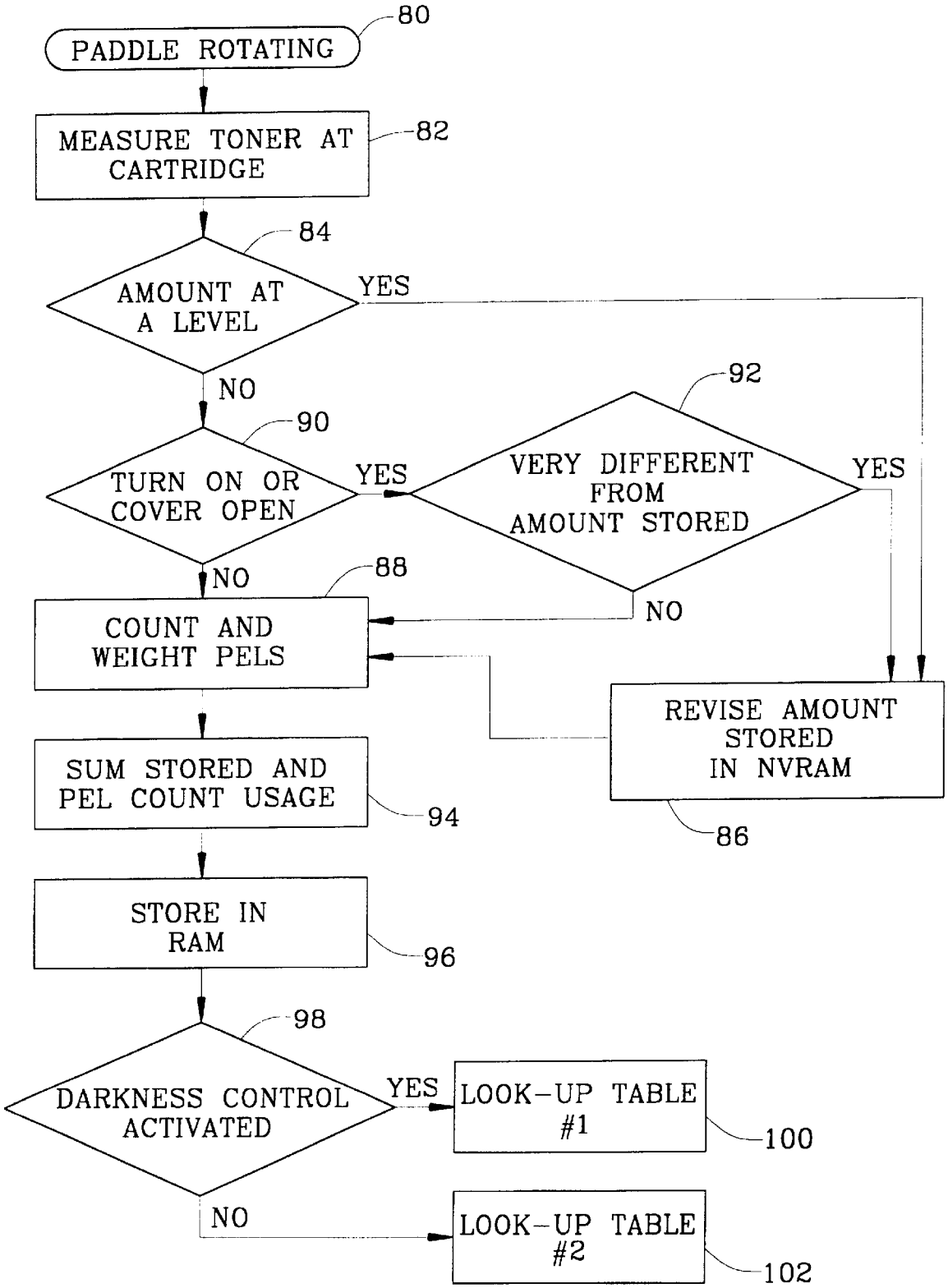
FIG. 6 is a flow diagram of the control operation in accordance with this invention.

FIG. 5 illustrates a printer 70 with data processing apparatus resident in the imaging device employing a cartridge as described in the foregoing. The imaging device has a microprocessor 72 for data processing operations. Alternatively, microprocessor 72 may be special purpose logic such as an ASIC (application specific integrated circuit). Microprocessor 72 issues control signals to the printer and cartridge on output conductors 74 (shown illustratively as a single lead). Microprocessor 72 connects to both RAM memory 76 and NVRAM memory 78. As is entirely standard, microprocessor 72 is programmed by a series of instructions to carry out required sequences of control signals on output conductors 74. In accordance with this invention, those sequences include the following, as shown in FIG. 6.

Upon all paddle rotation, status 80, the toner measurement at the cartridge is conducted in action 82

Where cartridge measurement is by the torsion spring system of measurement, the reading is the average of five consecutive measurements, since toner positioning is variable in such a system. When the cartridge measuring system observes toner at a first predetermined level in decision 84. Action 86 stores that amount of toner in NVRAM 78 and transmits that amount to action 88 as a new base level for summing. Subsequent usage is tracked by pel counting until decision 84 recognizes the next higher predetermined level, at which decision 84 becomes yes and action 86 is revised with that new amount. A representative number of such predetermined levels are six, corresponding to ½ full, ⅘ full, ⅗ full, ⅖ full ⅕ full and empty.

When decision 84 is no, decision 90 determines if the printer status is that of first activation after turn on or cover open. If yes, decision 92 determines if the amount measured in action 82 is greatly different by some predetermined amount than the amount stored in NVRAM 78. When decision 92 is yes, NVRAM 78 is revised in action 86 to contain the amount measured at the cartridge in action 82, When decision 92 is no, action 88 is invoked without revision of NVRAM.

When decision 90 is no, action 92 is bypassed and action 88 is invoked. Thus, decision 92 normally provides for a correct revision if the cartridge has been changed, but does not write to NVRAM 78 where that can be avoided, since writing to an NVRAM tends to limit its useful life.

When the cartridge contains a lot of toner, in the torsion spring measuring system measurement at the cartridge will simply show full during a period of considerable toner usage. During this period toner usage is tracked by pel counting in action 88 during printing, The amount of toner used for each pel varies with the darkness setting of printer 70 and with previous toner usage from full. (The variance with toner usage is because the finer particles in toner tend to print in preference to larger particles.) Accordingly, in action 88 pel usage is weighted by a scale based on previous toner usage from the originally full cartridge to define current usage for each pel. Total usage is summed in action 94, which adds the usage stored in NVRAM 78 and the usage found by counting pels and weighting the count of each pel in accordance with current usage, as well as, of course, weighting in accordance with the darkness setting. In action 90 this amount is stored in RAM 76.

This darkness compensation function may be deactivated from a control panel of printer 70 or by code in a print job. Decision 98 determines if darkness compensation is activated. If yes, the usage information of action 96 is employed in action 100 in a table look-up of a first table to determine the operating parameters for darkness compensation. If decision 98 is no, parameter for non-darkness shift are obtained from a second table in action 102. These operating parameters are then communicated to the printing mechanism on output conductors 74 to control one or more of the operating factors toward constant darkness printing.

In this way the cartridge measuring system is treated as more reliable during overall use, as usage with each pel is somewhat variable depending on the image being printed, particularly if the image is graphics rather than text. Moreover, the NVRAM is written to sparingly.

Actual factors for changing weighting of toner used by pels and for modifying operating points are unique to each imaging device and are obtained by actual testing and observation of a representative one of such device.

It will be apparent that the order of some of the decisions illustrated in FIG. 6 may be varied. For example, the determination of whether the printer is being activated after turn off or cover open can precede any measurement at the cartridge.

What is claimed is:

1. An imaging device comprising a toner container having a measurement capability to determine an amount of toner used from said container, said imaging device having at least one operating factor to vary the darkness of imaging, and data processing apparatus to determine toner usage periodically using said measurement capability of said toner container as a first toner usage amount, and subsequently summing to said first amount amounts using pels printed to determine a current toner usage amount, and subsequently replacing said current toner usage amount with the toner usage amount determined by a subsequent use of said measurement capability of said toner container; said data processing apparatus adjusting said at least one operating factor toward constant darkness imaging in accordance with said determined usage.

2. The imaging device as in claim 1 in which said determination of toner usage includes counting the sum of pels printed between periodic measurements using said measurement capability of said toner container.

3. The imaging device as in claim 2 in which said data processing apparatus comprises non-volatile memory and said amount of usage by said measurement capability of said toner cartridge is stored in said non-volatile memory when said determination reaches predetermined levels.

4. The imaging device as in claim 3 in which at power-on and at cover open of said imaging device said data processing apparatus determines the amount of toner usage from said measurement capability of said toner container and replaces said amount of usage in said nonvolatile memory when they differ by a predetermined amount.

5. The imaging device as in claim 4 in which said toner container is a toner cartridge that may be separated from said imaging device and replaced.

6. The imaging device as in claim 4 in which said determination of toner usage including counting of pels also includes weighting the amount determined for pels counted based on the amount of toner used from said container.

7. The imaging device as in claim 3 in which said toner container is a toner cartridge that may be separated from said printer imaging device and replaced.

8. The imaging device as in claim 3 in which said determination of toner usage including counting of pels also includes weighting the amount determined for pels counted based on the amount of toner used from said container.

9. The imaging device as in claim 2 in which said toner container is a toner cartridge that may be separated from said imaging device and replaced.

10. The imaging device as in claim 2 in which said determination of toner usage including counting of pels also includes weighting the amount determined for pels counted based on the amount of toner used from said container.

11. The imaging device as in claim 1 in which said data processing apparatus comprises non-volatile memory and said amount of usage by said measurement capability of said toner cartridge is stored in said nonvolatile memory when said determination reaches predetermined levels.

12. The imaging device as in claim 11 in which at power-on and at cover open of said imaging device said data processing apparatus determines the amount of toner usage from said measurement capability of said toner container and replaces said amount of usage in said non-volatile memory when they differ by a predetermined amount.

13. The imaging device as in claim 12 in which said toner container is a toner cartridge that may be separated from said imaging device and replaced.

14. The imaging device as in claims 11 in which said toner contain is a toner cartridge that may be separated from said imaging device and replaced.

15. The imaging device as in claim 1 in which said toner container is a toner cartridge that may be separated from said imaging device and replaced.

16. An imaging device comprising a toner container having a measurement capability to determine an amount of toner used from said container, and data processing apparatus to periodically determine toner usage by using said measurement capability of said toner container and to determine toner usage by counting the sum of pels printed between said periodic measurement using said measurement capability of said container, and to sum said usage determined at the last determination using said measurement capability of said toner container and usage determined by said counting pels after said last determination using said measurement capability of said toner container, wherein said determination of toner usage by counting pels also includes weighting the amount determined for pels counted based on the amount of toner used from said container.

17. The imaging device as in claim 16 in which said data processing apparatus comprises non-volatile memory and said amount of usage by said measurement capability of said toner cartridge is stored in said non-volatile memory when usage of toner measured reaches predetermined levels.

* * * * *